United States Patent [19]

Crowther et al.

[11] 4,038,160

[45] July 26, 1977

[54] METHOD OF REGENERATING A CHROMIUM ELECTROPLATING BATH

[75] Inventors: John Cooper Crowther, Stourbridge; Stanley Renton, Penkridge, both of England

[73] Assignee: Albright & Wilson Limited, Oldbury, Warley, England

[21] Appl. No.: 702,374

[22] Filed: July 2, 1976

[30] Foreign Application Priority Data

July 3, 1975 United Kingdom ..... 28055/75

[51] Int. Cl.[2] ..... C25D 3/06; B01D 9/02

[52] U.S. Cl. ..... 204/51; 210/42 R

[58] Field of Search ..... 204/51, 105 R; 210/42 R

[56] References Cited

U.S. PATENT DOCUMENTS 3,954,574 5/1976 Gyllenspetz et al. ..... 204/51 X

*Primary Examiner*—G. L. Kaplan

*Attorney, Agent, or Firm*—Flynn & Frishauf

[57] ABSTRACT

Trivalent chromium electroplating baths which have developed characteristic faults due to accumulation of trace metal contaminants are treated with just sufficient of a water soluble ferrocyanide to restore the bath to normal working order.

6 Claims, No Drawings

METHOD OF REGENERATING A CHROMIUM ELECTROPLATING BATH

The present invention relates to chromium electroplating, and in particular to the maintenance of electroplating baths based on trivalent chromium.

Although the potential advantages of electroplating from solutions containing chromium in the trivalent state have been recognised for over 50 years, until recently a variety of practical difficulties have prevented the commercial adoption of any such solution. Chromium has therefore always been electroplated from baths containing the chromium in the hexavalent state, despite certain serious disadvantages of such baths.

Recently, however, various proposals have been made for overcoming at least some of the aforesaid difficulties. One type of bath in particular, containing a trivalent chromium salt, a formate, a bromide and ammonium as essential ingredients is described in our U.S. Pat. No. 3,954,574. A process based on such a bath has recently been introduced commercially and is already gaining widespread acceptance as a replacement for hexavalent chromium plating baths.

However, it has been discovered that some trivalent chromium plating baths, which work satisfactorily under laboratory or test conditions, sometimes develop plating defects after they have been installed commercially. In particular at least one, and usually a combination, of the following faults may occur:

A. A white haze at high current densities, which may, in severe cases, spread progressively to lower current densities.

B. A white band at the lower limit of the plating range, often accompanied by loss of adhesion at high current densities.

C. A white deposit at current densities of around 50 amps per square foot.

D. Brown or black smudges between about 100 and 200 amps per square foot.

We have now discovered that the aforesaid faults may, in many cases, be reduced or overcome by adding a small amount of water soluble ferrocyanide to the plating solution, whenever the faults are observed.

Our invention therefore, according to one aspect, provides a method for the maintenance of an aqueous trivalent chromium electroplating bath which has begun to exhibit at least one of the aforesaid faults, which comprises adding thereto a sufficient amount of a water soluble ferrocyanide substantially to reduce or prevent said fault.

We have found that the invention is applicable to the maintenance of trivalent chromium electroplating baths generally. For example it may be employed with baths of the type described in our aforesaid U.S. patent, or with baths containing glycollic acid such as are described in U.S. Pat. No. 3,706,636 to 3,706,643. The invention may also be used, for example, in combination with baths of the type described in British Pat. No. 1,144,913, U.S. Pat. Nos. 3,021,267, 3,006,823, 3,069,333 and 3,111,464.

Generally speaking the baths contain a trivalent chromium salt, such as chromium chloride, sulphate or fluoride and a complexing agent such as a carboxylic acid, preferably a formate, or alternatively, for example, an acetate, glycollate or oxalate. Halides especially bromide are preferably present. The solution preferably contains alkali metal ions, for example sodium and/or potassium, and sulphate ions. Aprotic dipolar solvents such as dimethyl formamide may also be included but are preferably absent. Typically the pH of the bath is between 1 and 7, for example 1.5 to 5.

The ferrocyanide may be any ferrocyanide which is soluble in the bath, for example an alkali metal or ammonium ferrocyanide, for example sodium or potassium ferrocyanide.

The ferrocyanide may conveniently be added to the bath as an aqueous solution. The concentration of the ferrocyanide solution is not critical, and will normally be chosen according to the solubility of the particular ferrocyanide employed. For example using potassium ferrocyanide we prefer to employ a solution containing about 20% by weight ferrocyanide.

We have found that addition of ferrocyanide in amounts in excess of those required to eliminate the aforesaid faults, may cause a deterioration in the performance of the bath. One way of avoiding this problem when the onset of any of the aforesaid faults is observed, is to add the ferrocyanide solution in small increments until the chromium deposit is satisfactory again. If a sufficient excess of ferrocyanide has accidentally been added to cause a significant deterioration, it is possible to remove the excess by adding a small amount of soluble cation such as copper, nickel, iron or zinc. In most plating shops this may conveniently be achieved by adding a small amount of nickel plating solution to the bath. The addition of metal ion should be made within 15 minutes preferably within 10 minutes of adding the ferrocyanide, in order to be fully effective, since on standing the excess ferrocyanide complexes with the chromium and is then difficult or impossible to precipitate with the added metal.

We believe that the aforesaid faults may be due to the accidental contamination of the bath by traces of metal cations, which are capable of codepositing with the chromium. Our experiments have shown that fault A can be simulated by adding copper to the bath; similarly fault B appears to be associated with the presence of zinc, fault C with lead and fault D with nickel. It seems, surprisingly, that the ferrocyanide is capable of precipitating substantially all of the potentially harmful trace metals which are most commonly encountered in very low concentrations as contaminants in commercial practice, but without precipitating the chromium, which is principal cationic constituent of the bath.

According to a preferred embodiment, therefore our invention provides a method of maintaining a trivalent chromium plating bath which exhibits plating defects associated with the codeposition with the chromium of trace metal contaminants, which method comprises analysing the bath to determine the concentration of said trace metal contaminants in the bath and adding a water soluble ferrocyanide in an amount sufficient to precipitate said contaminants.

Preferably the bath or any sample used for analysis should be filtered to remove any previously precipitated metal prior to the analysis.

The analysis of the bath may be carried out by any of the analytical techniques for quantitative determination of the trace metals which are well known in the art. Typically the bath may be analysed by spectographic means, for example by spark ionisation or atomic absorption. Alternatively polarographic means may be employed.

Usually it is only necessary to test for copper, zinc, iron and nickel, since these are the only metals which, in our experience, are likely to cause difficulties in practice. The invention is however applicable to the correction of plating faults due to the presence of metals, such as lead, cadmium, silver and gold, although significant contamination by such metals is unlikely to occur in practice.

The amount of ferrocyanide added is preferably substantially stoichiometric based on the trace metal contaminants present, or slightly less. Any substantial excess of ferrocyanide should be avoided. Addition of any effective quantity significantly less than the stoichiometric amount, while beneficial, may not entirely remove the plating fault. We have discovered that a good rule of thumb is to add 1 ml. of 20% potassium ferrocyanide solution per liter of plating solution for every 50 ppm of trace metal contamination. In this way the bath can be relatively easily maintained in the face of at least the commonly encountered forms of contamination.

It is preferred to reduce any free halogen in the bath to halide prior to addition of the ferrocyanide, by addition of a reducing agent capable of converting halogen to halide, without adversely affecting the performance of the bath. One particularly suitable reducing agent for this purpose is ammonium formate. The proportion of formate is preferably sufficient to reduce all the free halogen in the solution. Typically 2 to 3 gms per liter of formate may be added, preferably as an aqueous solution. The formate is preferably added with agitation, about 10 minutes prior to the ferrocyanide addition. Halogen is usually present in the bath immediately after plating.

The invention will be illustrated by the following Examples:

EXAMPLE 1

A trivalent chromium plating solution which had been working satisfactorily developed a plating fault, giving dark smudges in the 100-200 ASF region. A sample of the solution was put into a 300 ml Hull Cell with circulatory cooling and a 10 amp 3 minute panel run. This parcel showed black streaks between 100–200 ASF and from previous experience was diagnosed as being due to nickel and possibly iron contamination of the solution. It was estalished that some nickel plated components had been lost from plating jigs and had been dissolving in the electrolyte for some time. The electrolyte was analysed spectroscopically for trace metals as follows:

| | |
|---|---|
| Nickel | 134 |
| Copper | 13 |
| Iron | 193 |
| Zinc | 26 |
| Total Metals: | 366 |

A 20% w/v solution of potassium ferrocyanide ($K_4Fe(CN)_6.3H_20$) was prepared and 1 ml of this solution added per 50 ppm total metals per liter i.e. 7 ml per liter were actually added. The mixture was allowed to stand for 30 minutes and then used for plating components. The black streaks were completely absent and normal plating performance was regained.

Subsequent analysis of the electrolyte gave the following result:

| | ppm | % removal |
|---|---|---|
| Nickel | 20 | 85 |
| Iron | 98* | (49) |
| Copper | 4 | 69 |
| Zinc | 8 | 69 |

*this figure will include a contribution from any excess reagent.

EXAMPLE 2

A similar electrolyte contaminated with iron, nickel, copper and zinc gave plating faults. In this case no trace metal analysis was available. Halogen was reduced by addition to the bath of 5ml/liter of 55% w/w ammonium formate solution. The bath was agitated for 10 minutes, and then 20% potassium ferrocyanide was added in a stepwise fashion, beginning with 1 ml per liter of electrolyte and increasing the addition in 1 ml per liter steps, allowing 30 minutes reaction time between additions. Some improvement was noted after the addition of 3 ml per liter and fully satisfactory performance was achieved at 5 ml per liter. The precipitate of insoluble metal salts was allowed to remain in the bath and did not interfere with plating in any way, but the solution was filtered at the next shutdown to remove the precipitated metals.

We claim:

1. A method for the maintenance of an aqueous trivalent chromium electroplating bath whose performance has deteriorated due to the accumulation of trace metals which consists in adding thereto an amount of a water soluble ferrocyanide effective to restore said performance.

2. A method as claimed in claim 1 wherein said water soluble ferrocyanide is selected from the group consisting of sodium, potassium and ammonium ferrocyanide.

3. A method as claimed in claim 2 wherein said water soluble ferrocyanide is potassium ferrocyanide.

4. A method as claimed in claim 2 wherein the proportion of trace metal contaminants is determined and an amount of said ferrocyanide is added just sufficient to precipitate essentially all said trace metal from the bath.

5. A method according to claim 1 wherein sufficient ammonium formate is added to the bath, prior to the addition thereto of ferrocyanide, to reduce essentially all of any halogen contained therein to halide.

6. A method as claimed in claim 4 wherein said ferrocyanide is added in an amount of about 1 ml of about 20% w/w ferrocyanide solution per liter of the bath for every 50 ppm trace metal contamination.

* * * * *